US008272638B2

(12) United States Patent
König

(10) Patent No.: US 8,272,638 B2
(45) Date of Patent: Sep. 25, 2012

(54) DEVICE FOR THE TRANSPORT OF FLAT OBJECTS

(75) Inventor: Klaus König, Constance (DE)

(73) Assignee: Siemens Aktiengesellschaft, Munich (DE)

( * ) Notice: Subject to any disclaimer, the term of this patent is extended or adjusted under 35 U.S.C. 154(b) by 365 days.

(21) Appl. No.: 12/388,854

(22) Filed: Feb. 19, 2009

(65) Prior Publication Data

US 2009/0212492 A1 Aug. 27, 2009

(30) Foreign Application Priority Data

Feb. 19, 2008 (DE) ..... 10 2008 009 876

(51) Int. Cl.
*B65H 29/66* (2006.01)
*B65H 9/04* (2006.01)

(52) U.S. Cl. ..... 271/202; 271/243

(58) Field of Classification Search ..... 271/243, 271/69, 272, 62, 202
See application file for complete search history.

(56) References Cited

U.S. PATENT DOCUMENTS 3,902,715 A * 9/1975 Hubler et al. ..... 271/243
4,425,694 A 1/1984 Somerville
4,441,703 A * 4/1984 Faltin ..... 271/243
5,374,053 A * 12/1994 Doucet et al. ..... 271/243
6,293,544 B1 * 9/2001 Fedinatz ..... 271/243
6,443,448 B1 9/2002 Mohr et al.
7,364,158 B2 * 4/2008 Ishikawa et al. ..... 271/273
2004/0113356 A1 * 6/2004 Stemmle ..... 271/220

FOREIGN PATENT DOCUMENTS

| | | | |
|---|---|---|---|
| AU | 4433297 | A | 5/1998 |
| CA | 2219957 | A1 | 5/1998 |
| DE | 19753419 | C1 | 2/1999 |
| EP | 0731046 | A2 | 9/1996 |
| EP | 0860386 | A1 | 8/1998 |
| EP | 1034046 | A1 | 9/2000 |
| JP | 03111370 | * | 5/1991 |
| JP | 05270688 | * | 10/1993 |
| JP | 06032511 | * | 2/1994 |

* cited by examiner

*Primary Examiner* — Kaitlin Joerger
*Assistant Examiner* — Patrick Cicchino
(74) *Attorney, Agent, or Firm* — Laurence A. Greenberg; Werner H. Stemer; Ralph E. Locher

(57) ABSTRACT

A device for transporting flat objects, such as mail items, has two transport tracks and an acceleration device arranged between the transport tracks. The acceleration device includes a clamping pair for holding the objects in a clamped manner on their opposing flat sides while the objects are moving. To be able to carefully accelerate objects of different thicknesses, it is proposed that at least one clamp of the clamping pair includes a segment unit with several segments of different configuration for clamping objects of different thicknesses.

9 Claims, 2 Drawing Sheets

DEVICE FOR THE TRANSPORT OF FLAT OBJECTS

CROSS-REFERENCE TO RELATED APPLICATION

This application claims the priority, under 35 U.S.C. §119, of German patent application DE 10 2008 009876.0, filed Feb. 19, 2008; the prior application is herewith incorporated by reference in its entirety.

BACKGROUND OF THE INVENTION

Field of the Invention

The invention relates to a device for the transport of flat objects with two transport tracks and an acceleration means arranged between the transport tracks, with a clamping pair for holding the objects in a clamped manner on their opposing flat sides while the objects are moving.

Flat mail items such as letters, large letters, postcards, sealed periodicals and the like are sorted in sorting offices or main post offices in large numbers according to their addresses. The mail items are separated by a separating device in suitable sorting systems and clamped between endless conveyor belts at high speed, with little space in between, and transported to downstream modules where they are read, processed and sorted. During the transport of the mail items in the covered conveyor system, which is interrupted by switches, belt disconnection points, etc., the mail items can, due to different physical properties such as coefficient of friction, thickness or flexural rigidity, move in varying ways to the transport means and thus in the transport stream, i.e. relative to each other, which causes the gaps between the mail items to change.

Particularly with long transport sections with many sorting terminals, the mail items can move quite considerably relative to each other. If this causes the gap between individual mail items to reduce below a minimum gap, both of the mail items arranged around the undersized gap have to be ejected and cannot be sorted further. To avoid such a rejection, undersized gaps are increased in size by devices for correcting the gaps. Such a device is, for example, known from commonly assigned U.S. Pat. No. 6,443,448 and European patent EP 1034046 B1. With the aid of that device, a mail item is either positively or negatively accelerated in each case in order to even up the gaps as much as possible before and after this mail item. For this purpose, the device includes a clamping pair consisting of two opposing endless belts of a transport means. The mail item to be corrected is passed from an upstream track of the transport means to the clamping pair, where it is positively or negatively accelerated. The corrected mail item is then passed on to the next track of the transport means where it is transported onwards at the same or a different transport speed.

SUMMARY OF THE INVENTION

It is accordingly an object of the invention to provide a device for transporting flat objects which overcomes the above-mentioned disadvantages of the heretofore-known devices and methods of this general type and which provides for an improved device for accelerating flat objects by means of which different objects can be accelerated in a simple manner.

With the foregoing and other objects in view there is provided, in accordance with the invention, a device for transporting flat objects, comprising:

two transport tracks;

an acceleration device arranged between the transport tracks, the acceleration device including a clamping pair for clampingly holding the flat objects on opposing flat sides thereof during a movement of the objects;

the clamping pair including at least one clamp with a segment unit having a plurality of segments of different design for clamping objects of mutually different thicknesses.

In other words, the objects of the invention are achieved in that at least one clamp of the clamping pair has a segment unit with several segments of varying design for clamping objects of different thicknesses.

The invention in this case is based on the concept that normally only a short acceleration section is available for gap correction before the following object has reached the acceleration means and the acceleration of the preceding object has to be ended. The forces which act on an object to accelerate it are therefore relatively high, which means that objects normally have to be tightly clamped by the acceleration means. The forces which are applied to the object by such clamping are in this case very dependent on the thickness of the clamped object. If the clamping cannot be adjusted to the thickness of the object, objects which are thick are subject to severe mechanical stress.

By means of the segment unit with several segments of different design for clamping objects of different thicknesses this disadvantage can be overcome and objects of varying thicknesses can be clamped and accelerated corresponding to their thickness, with the mechanical stress thus remaining small even with thick objects. The use of a segment unit renders the requirement for several correction sections arranged in parallel for objects of different thicknesses unnecessary and the number of necessary switches and actuators can be kept low.

The acceleration means is used to hold and accelerate the objects. The acceleration can be a positive acceleration in the direction of transportation or a negative acceleration in the form of a deceleration. The movement of the acceleration means or of the clamping pair is advantageously controlled by means of a control unit, which includes a data processing unit.

The objects can be postal goods of all kinds, especially mail items such as letters, large letters, postcards, periodicals, and the like. They are preferably rectangular and, if the third dimension of the thickness of the object is included, can be cuboidal. They can have two long edges in the direction of their largest extension and two transverse edges transverse to those, with the objects advantageously being placed in a stack on their long edges. Objects can be considered flat if their thickness does not exceed 20% of the length of a transverse edge.

Both tracks of the transport means at both ends of the acceleration means are, for the transport of a stream of consecutive vertically arranged transported objects, advantageously provided with gaps between the objects so that they reach the acceleration means individually. The clamping pair includes two clamps arranged opposite each other for clamping the objects on both sides, with one of the clamps being advantageously designed as an endless conveyor. The endless conveyor is advantageously passed around at least two opposite rollers with the clamp with the segment unit being advantageously guided between both rollers on the other clamp. This enables an advantageous amount of flexibility to be achieved during clamping.

Each of the segments of the segment unit serves advantageously for clamping an object, with the segment unit being designed so that advantageously at any one time only one segment is used for clamping an object, with the other segment being at such a distance from the opposite clamp that no clamping of an object is useful, for example, because a segment limit would then be involved in the clamping.

In an advantageous embodiment of the invention, the segment unit has a rotatable rotator carrying the segments along its circumference. This enables a segment unit to be embodied as particularly simple and robust and said segment unit can perform its function with only a few moving elements. The rotator is advantageously designed as a disc, which means that its mass moment of inertia can be kept low.

This enables a segment arrangement to be particularly easily realized because the segments have different radii of a rotator. If the rotator is designed as a disc with a wheel shape, a low mass moment of inertia can be achieved, so that it can be accelerated by using a small amount of force. A wheel shape is obtained in this connection in that the rotator has at least one, advantageously several, openings between its hub area and its circumference, which in particular make up at least 50% of the disc.

In a further variant of an embodiment of the invention, it is proposed that the segment unit has several rotatable disks which are offset in the direction of their axis of rotation and carry segments. A transfer belt of the transport mean can in this case engage between the discs, thus enabling a mail run-through which is gentler on the mail items to be achieved. Advantageously, all the discs carry the segments. They are therefore all provided with different designs of segment for clamping objects of different thicknesses, the disks jointly clamping an object.

If the transitions between the segments are rounded, a handling by the acceleration means can be achieved which is gentler on the objects.

The transitions between the segments advantageously include edges. These can be designed to grip around a transverse edge, aligned transversely relative to a direction of transport, of the object presently being accelerated, which enables a good guidance of this object to be achieved. The transverse edge of the object can be a front edge or a back edge.

An improved gap correction or lower acceleration of objects can be achieved if the device has several clamping pairs arranged in succession in the direction of transport between the tracks for the segment-related acceleration of objects. The objects in this case are advantageously accelerated in several steps, with each step being able to undertake part of the gap correction. The clamping pairs are advantageously designed as described above for the single clamping pair.

A further variant of the invention provides for the segment to form clamping sections, with the clamping sections of all the segments being of equal length. In this way, a good guidance of the objects up to the next transfer or clamping point can be achieved for all the thicknesses of the objects handled.

The segment unit together with the opposite clamp advantageously forms a clamping point, or even a clamping area where there is a certain elasticity of the opposite clamp, in which the object to be accelerated is clamped. In the track following the acceleration means, a clamping point is also present in which the object can be clamped for onward transportation. Both clamping points are spaced one section apart from each other. Advantageously, the clamping sections of all segments are of the same length as these sections. This means that a simultaneous clamping of the objects in both clamping points can be avoided, thus enabling the objects to be handled with care.

Advantageously, a segment immediately following a clamping segment is embodied so that it releases the clamped object. In this way objects which are longer than the section described above can also be accelerated even if they reach over both clamping points at the same point in time. The clamping point of the acceleration means is in this case released so that a double clamping of the object can be avoided.

The invention is also aimed at the use of a device, as described above, for the transport of flat mail items. Mail items are transported at high speed in sorting systems, with the result that a displacement of the mail items in the mail stream, especially a displacement forwards, is associated with a very high acceleration. Especially with heavy mail items, this causes a high mechanical stress on an envelope of the mail item. Due to the ability to vary the handling of the mail items relative to their thickness with the aid of the device, a displacement is enabled with which damage to envelopes can be reliably avoided.

Other features which are considered as characteristic for the invention are set forth in the appended claims.

Although the invention is illustrated and described herein as embodied in a device for the transport of flat objects, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
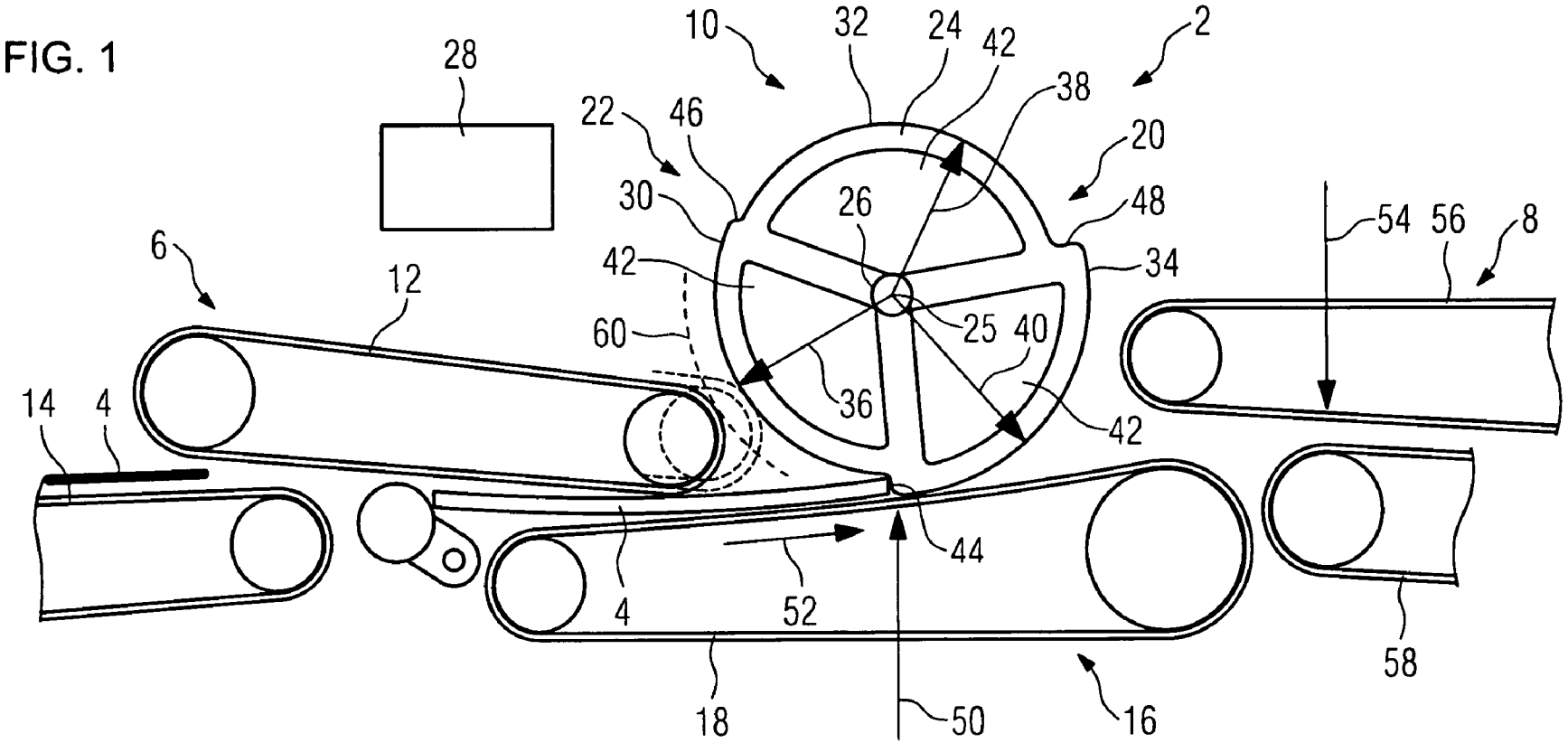
FIG. 1 shows a device for the transport of flat mail items with a rotator carrying three segments for the acceleration of mail items of different thicknesses.

Referring now to the figures of the drawing in detail and first, particularly, to FIG. 1 thereof, there is shown a section of a device 2 for the transport of flat objects, embodied as mail items 4, with a first transport track 6, a second transport track 8 and an acceleration means 10. Only sections of both transport tracks 6, 8 are shown in FIG. 1. Transport track 6 forms a part of a transport system, which includes endless guide belts 12, 14 passing around guide rollers and between which the mail items 4 are clamped for transport to the acceleration means 10. The acceleration means 10 has a first clamp 16 which is formed from an endless guide belt 18 which passes around two guide rollers. An opposite clamp 20 of the acceleration means 10 includes a segment unit 22 with a rotator 24 which can be motor-driven around an axis of rotation 25 with the aid of a drive 26. The drive can be a servomotor whose speed is controlled by a control means 28.

On its circumference, the rotator 24 has three different segments, 30, 32, 34, which are characterized by different radii 36, 38, 40. The rotator 24 is also embodied as a disc in the form of a wheel, inside which three openings 42 are formed to reduce the weight of the rotator 24. Outer edges, which are rounded for careful handling of the mail items, are formed at transitions 44, 46, 48 between the segments 30, 32, 34. Inner edges next to the outer edges are in each case not rounded.

The segments 30, 32, 34 form clamping sections whose length is determined by the radii 36, 38, 40 and the angle of the arc of the segments 30, 32, 34. All these three lengths are equal. As an alternative, it is also possible for segment 32 to have the smallest radius 38 with a somewhat longer clamping section, in order to also enable the acceleration of extremely thick, longer mail items 4. In this case, the segment length of the segment 32 with the smallest radius 38, i.e. its clamping section, should be at least as large as the maximum processable mail item length of the system of which the device 2 forms a component.

During the operation of the device 2, shown in plan view in FIG. 1, the thicknesses of the mail items 4 are determined in a processing module upstream of the accelerating means 10 and the corresponding data is transmitted to the control means 28. In this way, the thickness of the mail item 4 which will be next to reach the acceleration means 10 is known. The control means 28 positions the rotator 24 with the aid of the drive 26 so that the transition 44, 46, 48 suitable for the thickness of the next mail item 4 to arrive comes to rest at a transfer point 50. During this time, the mail items 4 are transported from the delivering transport track 6 with a first speed in transport direction 52 to the acceleration means 10 and reach the acceleration means 10 as a first time point, as shown in FIG. 1.

On the arrival of the front edge of the mail item 4, the drive 26 accelerates the rotator 24 to the first speed at which the mail item 4 is being moved at this moment, in order to avoid, at least as far as possible, a relative movement between the rotator 24 and the mail item 4. The guide belt 18, and with it both guide rollers tensioning said guide belt 18, are thus accelerated by friction with the rotator 24, also to the first speed.

Depending on the requirement, the rotator 24 now transports the mail item 4 in the transport direction 52 at a constant speed, or accelerates it or decelerates it. The requirement can, for example, be a required gap correction of gaps before and after the mail item 4 and is specified by the control means. If the rear gap is, for example, to be increased, the mail item 4 is positively accelerated by the rotator 24 to a second speed which is greater than the first speed. If on the other hand, the rear gap is to be smaller, the rotator 24 decelerates the mail item 4 to a second speed, which is lower than the first speed, i.e. accelerates the mail item 4 with a negative acceleration.

During the acceleration or transport, the mail item 4 is held clamped by the two clamps 16, 20, i.e. the rotator 24 and the guide belt 18, so that the corresponding acceleration forces can be transmitted to the mail item 4 without said mail item 4 slipping between the guide belt 18 and the rotator 24.

Figure 2:
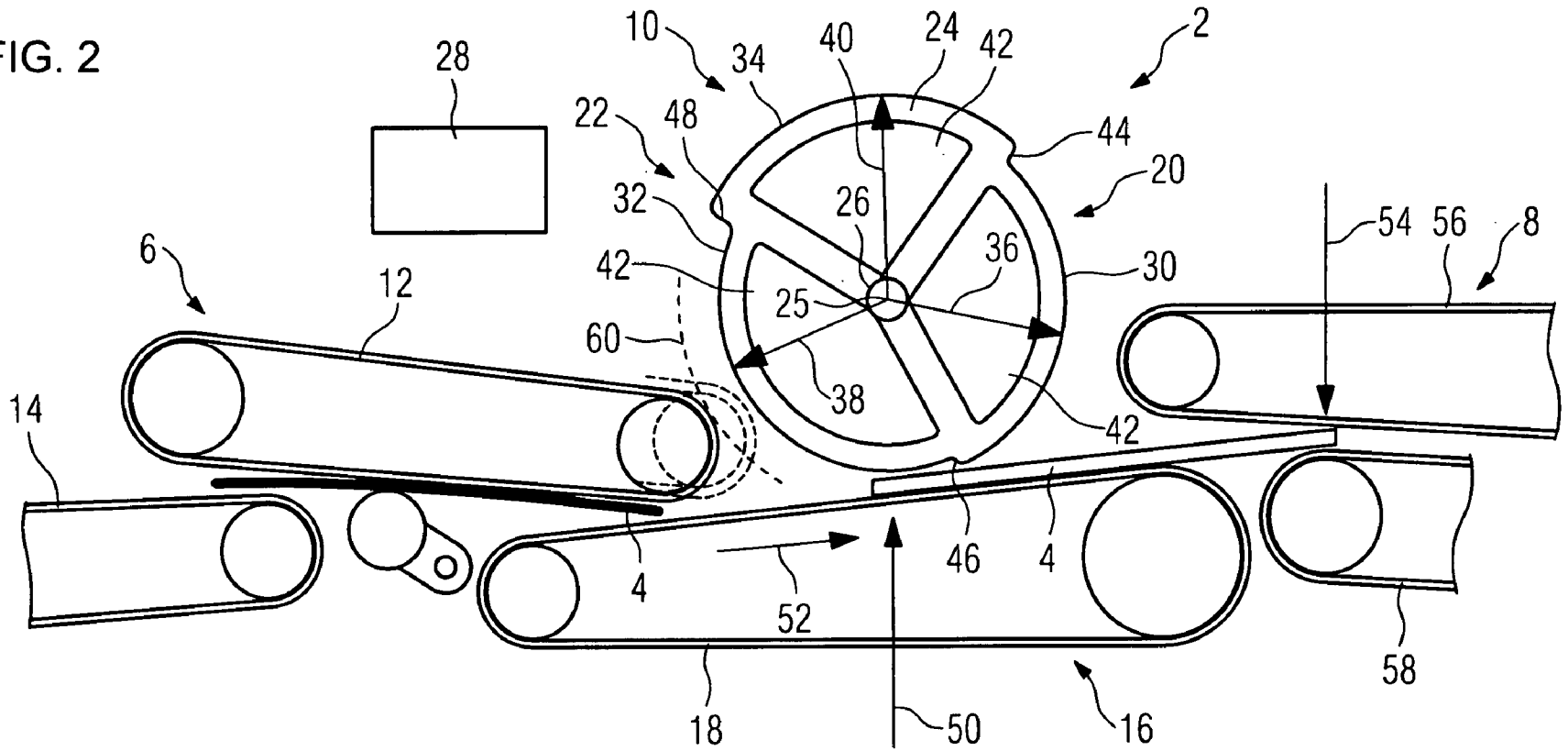
FIG. 2 shows the device at a later point in time with a rotator rotated further.

At a second point in time, as shown in FIG. 2, the front edge of the mail item 4 reaches a second transfer point 54 on the second transport track 8. From this transfer point 54, the mail item 4 is clamped between two guide belts 56, 58 of the onward forwarding transport track 8 and from there it is transported further at a third speed, which can be equal to or different from the first speed. As soon as the mail item front edge reaches the second transfer point 54, the rotator 24 must be at this third speed of the succeeding transport track 8, in order to avoid a relative speed of the mail item 4 to the two guide belts 56, 58. For this purpose, the mail item 4 is positively or negatively accelerated, depending upon the relationship between the second and third speeds, by the rotator 24 in the second acceleration time period.

The arc length of the segment 30 is thus designed so that the transfer 46 at the transfer point 50 is reached or exceeded as soon as the front edge of the mail item has reached the transfer point 54. Due to the smaller radius 38 of the following segment 32, the mail item 4 is released from the clamping between both clamps 16, 20 and can be transported onwards by the succeeding transport track 8, without continuing to be held clamped by the accelerator means 10.

The rotator 24 is now brought to a position by the control means 28 which is intended for acceleration of the succeeding mail item 4. Depending on the thickness of this succeeding mail item 4, one of the transitions 44, 46, 48 comes to rest at the transfer point 50. With the thinner succeeding mail item 4 illustrated in the figures, the transition 48 comes to rest with the succeeding segment 34 with the largest radius 40, because the succeeding mail item 4 falls into the category of the thinnest mail items 4.

With particularly thick mail items, the transition 46 is brought to the position of the transfer point 50. If the edge of this thick mail item reaches the transition 46 for acceptance of this mail item, the above process takes place, and the thick mail item is accelerated on the path to the transfer point 54 or is transported onwards at a constant speed. Because no release of the mail item by an even smaller radius is possible at the end of this acceleration or transportation, the arc length between the transitions 46, 48 determines the maximum length of such extremely thick mail items, because the radius of the rotator 24 at the transition 48 increases again and therefore the mail item at this point will be pressed too strongly against the guide belt 18 and would be heavily mechanically stressed.

A further exemplary embodiment is shown by dashes in the figures. In this case the acceleration means 10 has several discs 60, which carry the segments 30, 32, 34 and are arranged offset in the direction of the axis of rotation 24. The discs 60 are arranged spaced apart from each other so that the guide belt 12 of the first transport track 6 can engage between the discs 60, as shown by a section of the guide belt 12 represented by a line of short dashes. This enables the guide belt 12 to move closer to the rotator 24 which reduces the freedom of movement of the mail items 4 and means that the mail items 4 can be transported with more care.

The invention claimed is:

1. A device for transporting flat objects, comprising:

two transport tracks;

an acceleration device arranged between said transport tracks, said acceleration device including a clamping pair for clampingly holding the flat objects on opposing flat sides thereof during a movement of the objects;

said clamping pair including at least one clamp with a segment unit having a plurality of segments of different design for clamping objects of different thicknesses, said segment unit having a rotatable rotator carrying said segments along a circumference thereof;

said segments defining circular arcs of said rotator, said circular arcs having different radii, the different radii each being measured from a rotational center of said rotator to said circular arcs, said arcs being concentric with the rotational center of said rotator, a length of the arcs being determined by the radius and the angle of the respective arc.

2. The device according to claim 1, wherein said rotator is a disc in a shape of a wheel.

3. The device according to claim 1, wherein said segment unit includes a plurality of rotatable discs carrying said segments and being disposed at an offset in a direction of an axis of rotation thereof.

4. The device according to claim 3, wherein said transport tracks include elements entering in between said discs.

5. The device according to claim 1, wherein said segment unit has rounded transitions between said segments.

6. The device according to claim 1, wherein said segment unit is formed with edges between said plurality of segments for gripping around an edge of the flat objects aligned transverse to a transport direction.

7. The device according to claim 1, wherein said segments form clamping sections, and all of the clamping sections of all segments are of equal length.

8. The device according to claim 1, wherein a segment immediately following a clamping segment in a transport direction is configured to release the clamped object.

9. A method of transporting flat mail items, which comprises providing a device according to claim 1 and transporting the flat mail items therethrough.

* * * * *